US005187466A

United States Patent [19]

Pichl

[11] Patent Number: 5,187,466

[45] Date of Patent: Feb. 16, 1993

[54] METHOD OF DEACTIVATING A RESONANCE LABEL

[75] Inventor: Fritz Pichl, Kilchberg, Switzerland

[73] Assignee: Kobe Properties Limited, Isle of Man, Isle of Man

[21] Appl. No.: 733,860

[22] Filed: Jul. 22, 1991

[30] Foreign Application Priority Data

Apr. 16, 1991 [CH] Switzerland ..... 1132/91

[51] Int. Cl.[5] ..... G08B 13/24

[52] U.S. Cl. ..... 340/572

[58] Field of Search ..... 340/572

[56] References Cited

U.S. PATENT DOCUMENTS 4,686,516 8/1987 Humphrey ..... 340/572

5,081,445 1/1992 Gill et al. ..... 340/572

*Primary Examiner*—Glen R. Swann, III

*Attorney, Agent, or Firm*—Laurence R. Brown

[57] ABSTRACT

The method of producing an oscillating circuit on a label capable of being deactivated consists essentially of moving two surfaces of a capacitor together by a heated rod. Due to the heated rod dielectric material melts and the two capacitor surfaces become short circuited. Upon application of an appropriate current/voltage source, this short circuit is removed by burning or melting away to form a crater-like hole in a thinner surface of the capacitor. This produces a state of the label which allows, in a later deactivation step, a positive short circuiting. When the capacitor surfaces are moved together, the electrical connection between the two surfaces connects the crater forming source. Thereafter, a short circuit between the surfaces appears only when the label is passed through a deactivating station.

13 Claims, 1 Drawing Sheet

METHOD OF DEACTIVATING A RESONANCE LABEL

BACKGROUND OF THE INVENTION

1. Field of the Invention

The present invention relates to a method of deactivating a resonance label such as specifically used in shop burglary safety systems, which label includes a supporting layer formed of a dielectric material and bearing on the front and back side thereof the active surfaces, consisting preferably of aluminum the capacitor of an oscillating circuit being arranged at one side thereof.

The method comprises producing of a state between the two surfaces of the capacitor, whereby upon inducing of a deactivating current an electrical connection is formed, i.e. a short circuit between said surfaces.

2. Description of the Prior Art

One of the large problems encountered with resonance labels which presently are customarily used in antiburglary systems consists of deactivating the labels at the cash registers of the safeguarded shops in a reliable manner without contact. It is, thereby, important that the deactivating can be made in a relatively simple manner and, on the other hand, that once produced, the deactivation is reliable and final, i.e. such that the label can in no case release an alarm.

The deactivating proceeds as a rule with a short circuit established between the two surfaces of the capacitor of the oscillating circuit, such that the label when passing the exit gate can no longer release any alarm. Unfortunately the present systems have shown that the deactivating is not guaranteed with full reliability and accordingly false alarms are often released in cases where clients have properly paid the wares. Quite obviously such is detrimental to the reputation of a shop.

SUMMARY OF THE INVENTION

It is, therefore, a general object of the present invention to provide a novel deactivating method for resonance labels of the kind mentioned above, in which the deactivating may be made at a substantially increased safety compared with prior art and specifically in which a reactivation can not occur.

A further object of the invention is to provide a method comprising in a first phase of preparing the label, i.e. when producing the above mentioned deactivation state, the step of pressing the capacitor surfaces locally towards each other by means of a heated rod. Thus, the rod resting against one surface of the capacitor is connected to one pole of a current/voltage source and the other surface of the capacitor is connected to the other pole of the current source, such that a current flow appears, i.e. when the surfaces contact each other and/or are crimped to each other, the desired state can be supposed to be achieved. Accordingly the moving of said surfaces of the capacitor towards each other is terminated.

Thus, the two surfaces of the capacitor are now short circuited and the dielectric layer is completely displaced in a certain area.

In a further step (phase 2) a current/voltage source is again connected to the now short circuited capacitor and the crimping formed in phase 1 is burnt off by an electrical overload. By an appropriate adjusting of the ampere/volts ratio one surface of the capacitor, namely the thinner one, burns off in such a manner that the distance between the edge of the burnt out hole and the second surface of the capacitor corresponds just to the deactivatable distance.

A label prepared in such a manner can be deactivated at a desired moment by induction of an electric current in an already existing conventional deactivating station, thus producing a permanent conductive connection between the two surfaces of the capacitor.

Yet a further object is to provide a method in which the flow of the current obtained during the preparation of the label is simultaneously used to control a device which drives said pressing rod.

A further object is to provide a method in which the rod used in preparing the label is generally heated up to a temperature of about 300° C. to 500° C. The power source used to ascertain the contact between the two surfaces of the capacitor supplies preferably a current of about 50–100 milliamperes and a voltage of about 1 to 2 volts.

Still a further object is to provide a method in which an oscillating circuit is used of which the dielectric is formed by a plastic foil having excellent electrical properties, e.g. polyethylene of a thickness of 20$\mu$.

A further object is to provide a method in which the two surfaces of the capacitor, made for instance of aluminum, have a certain ratio of their thickness (e.g. about 10$\mu$ and 50$\mu$), i.e. a ratio of preferably about 1:5. During the preparing the polyethylene is now locally heated under the heated rod (diameter about 3–7 millimeters) and forced away under the pressure of the rod. The rod can be applied from the thicker and from the thinner surface of the capacitor, as well, preferably however, from the thinner surface. As soon as the approaching of the two surfaces of the capacitor results in a surface contact the process, i.e. phase 1 thereof, can be terminated. When this approaching or crimping is completed, a flow of current can occur. It can, therefore, be ascertained by a measuring that a complete approaching of the two metal surfaces has taken place. This appearing current flow is then also used for the controlling of the movement of the rod.

If the electrical connection is not interrupted after the withdrawal of the rod during the preparing of the label, measures are automatically taken to separate such a label from the others. Accordingly, labels which are defective from the beginning are removed from the production.

Yet a further object is to provide a method in which during the preparation of the label the two surfaces of the capacitor are approached locally to about 1.5 to 3.0$\mu$, such that generally available deactivating stations can be used for their deactivation.

In the following step, namely phase 2, the crimping is used for the final preparation of the label making it ready for deactivation. To this end the crimp connection is burned off by an electrical overloading. The heat produced thereby does not only burn one or several holes into the thin surface of the capacitor but also burns in this area the plastic foil forming the dielectric. This burning process depends from the current/voltage source applied and controls the desired distance between the lower edge of the hole and the second surface of the capacitor.

During this burning process at least one hole is produced in the thinner surface of the capacitor. Such holes have an irregular crater like edge. Said current/voltage source shall be able to supply about 10 to 20 volts and 2 to 3 amperes. The crater like openings thus produced have a diameter of e.g. 70μ whereby an air gap of 1.5 to 3μ has been formed at the area of the edge of the crater between the two surfaces of the capacitor. This step terminates the preparation of the oscillating circuit in view of a later deactivation thereof.

The deactivation as such is performed in the shop or store and specifically by using the customary deactivating station. In such a station an electrical current is induced between the prepared surfaces of the capacitor, leading in the present case definitely to the building up of an electrical connection in form of an aluminum thread between the two surfaces of the capacitor by a melting of the aluminum at at least one location. Under normal circumstances this short circuit can not be destroyed anymore and the label is therewith deactivated with the greatest possible safety.

Moreover, it has been found that the forming of the holes (craters) during the preparing of the labels occurs always in the thinner surface of the capacitor. This is associated with the fact that a complete melting of the material happens firstly in the thinner layer.

BRIEF DESCRIPTION OF THE DRAWINGS

The invention will be better understood and objects other than those set forth above will become apparent when consideration is given to the following detailed description thereof. Such description makes reference to the annexed drawings, wherein.

DESCRIPTION OF THE PREFERRED EMBODIMENT

Figure 1:
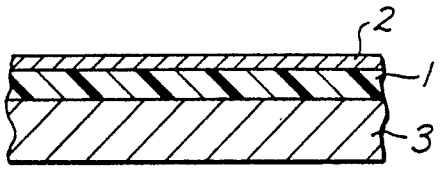
FIG. 1 is a fragment (in vertical section) of a resonance label for safety systems, including both surfaces of the capacitor, prior to its preparation for a later deactivating.

In FIG. 1 a resonance label is shown in section at the location where both sides of a dielectric 1, usually of polyethylene are covered by surfaces 2, 3 of a capacitor made of an aluminium foil. In view of the objects of the present invention it is advantageous to design the one surface 2 of the capacitor substantially thinner than the opposite surface 3 of the capacitor. In the practical embodiment a thickness ratio of 1:5 is selected.

Figure 2:
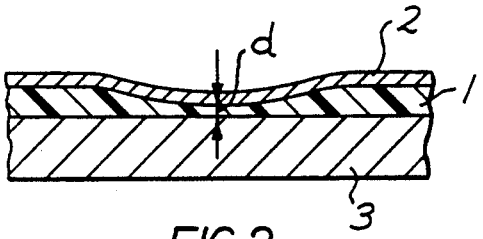
FIG. 2 illustrates also schematically, corresponding to FIG. 1, the desired ideal state of a prepared label with surfaces of the capacitor at a very close proximity but not short-circuited, and which are suitable for a deactivation.

FIG. 2 illustrates according to U.S. Pat. No. 4,498,076 that by moving the surfaces of the capacitor together a minimal distance d should be present at at least one location in order to achieve in a customary deactivating station a short circuit by application of a voltage or a current. The distance between the two surfaces of the capacitor should, thereby, amount to approximately 1 to 2.0μ. It shall be specifically noted that according to the aforementioned patent, a thin layer of the dielectric material remains present between the two surfaces of the capacitor. It may now be seen that during the deactivation carbonized dielectric material generates the short circuit.

Figure 3:
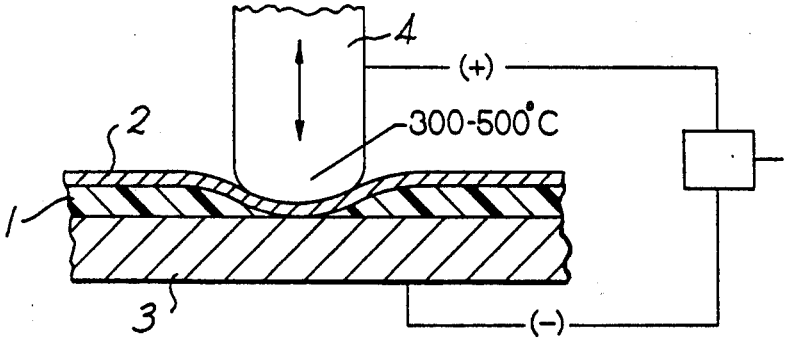
FIG. 3 is a similar illustration which discloses how the inventive preparing of a label during phase 1 proceeds by means of a rod which is under current and is heated.

FIG. 3 of the drawing illustrates how the two surfaces 2, 3 of the capacitor are moved close to each other in accordance with the inventive method by means of a rod 4 which is capable of moving to and fro and which preferably is heated up to about 300° C. to 500° C. Due to the heated rod 4 the dielectric material (polyethylene) is thereby melted below the rod and displaced completely. If a current/voltage source is on the one hand applied to the rod 4 which directly contacts the surface 2 of the capacitor and on the other hand to the second surface 3 of the capacitor, specifically connected to differing poles, a current will flow during the inventive procedure at a certain moment between the surfaces 2 and 3 of the capacitor. The flow of current thus serves as a signal that the dielectric material between the surfaces 2 and 3 of the capacitor has been removed completely.

Figure 4:
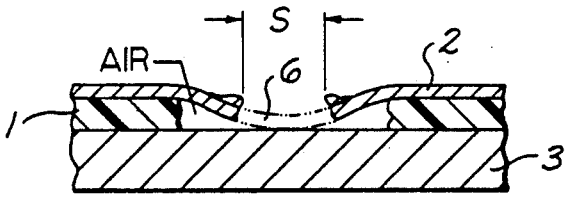
FIG. 4 is a section through a resonance label which was prepared in accordance with phase 2 of the inventive method.

FIG. 4 illustrates the cut-out of the capacitor in accordance with phase 2. The crimping has been removed by an electrical overload. This occurs here by a burning like procedure during which a crater shaped irregular hole 6 or a plurality of such holes are formed in the thinner surface of the capacitor. At the same time the dielectric material burns within the area of the edge of the hole between the two surfaces of the capacitor. Thereby an air gap S having a width of about 1.5 to 3μ is generated.

This hole 6 has a diameter of e.g. about 70μ. A part of the aluminium which has been melted away is thereby piled up at the edge of the hole and forms said crater.

FIG. 4 depicts further that the air gap extends further behind the edge of the crater and specifically beyond that area where the lower edge of the crater is at a distance of 3μ from the second surface of the capacitor. This guarantees that the deactivating occurs always by a metal thread.

This procedure can be used simultaneously as quality control. After phase 2 no current is allowed to flow from the one surface of the capacitor to the other one because obviously the crimping has been removed. If a current flows despite of this the oscillating circuit has been faulty from the beginning or it was not possible to disconnect the crimping. The fact that current still flows can be used in the form of a control signal asking for removal of the faulty label.

Figure 5:
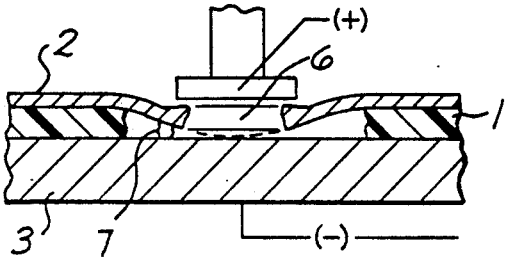
FIG. 5 illustrates the deactivating as such of a resonance label, whereby a permanent metal interconnection between the two surfaces of the capacitor is produced.

FIG. 5 of the drawings illustrates a prepared label which is located in a deactivating station. Due to the specific kind of the preparation a melting together of the edge of the opening 6 of the surface 2 of the capacitor and the free opposite surface 3 of the capacitor occurs definitely during this deactivation. A solid aluminium thread 7 is thereby produced which guarantees the short circuiting of the two surfaces of the capacitor and takes care with an absolute safety that the label is and remains deactivated.

While there is shown and decribed a present preferred embodiment of the invention, it is to be distinctly understood that the invention is not limited thereto, but may be otherwise variously embodied and practiced within the scope of the following claims.

I claim:

1. A method of producing resonance labels for use in shop burglary safety systems, said labels having metallic capacitor surfaces separated a substantially constant distance by virtue of being formed on two sides of a thermoplastic dielectric layer, said labels being prepared for deactivation in a deactivating system by short circuiting these surfaces, comprising the steps of:

deforming a local area of the dielectric layer to place the capacitor surfaces closer together at the local area to induce a short circuit between the surfaces by moving a heated metal rod against a first capacitor surface at the local area to thermally displace the dielectric layer and make conductive contact with the other capacitor surface, and passing an electric current between the capacitor surfaces in conductive contact of enough magnitude to permanently deform the materials around the local area and leave a gap between the surfaces so that the deactivating system can melt the capacitor surfaces together at the local area to form a permanent short circuit.

2. The method of claims 1, wherein said rod is heated to a temperature of 300° C. to 500° C.

3. The method of claim 1, wherein passing the electric current fully displaces the dielectric material from the local area between said surfaces of the capacitor.

4. The method of claim 1, wherein the step of passing electric current further comprises applying a current of about 2 to 3 amperes and a voltage of about 10 to 20 volts between said two surfaces of the capacitor.

5. The method of claim 1, wherein after said step of passing current said resonance label is no longer short-circuited and thus presents again substantially its original resonance frequency.

6. The method of claim 1, wherein the step of passing current burns out at least one hole in one surface of the capacitor.

7. The method of claim 6, wherein the burned out hole presents an irregular crater-like edge.

8. The method of claim 7 including the step of establishing a distance between the crater in one surface of the capacitor and the other surface of the capacitor of about 1.5 to 3$\mu$.

9. The method of claim 6, wherein the label presents an air gap between the capacitor surfaces in the area about the hole.

10. The method of claim 1, wherein the dielectric is a plastic foil having a thickness of about 15 to 25$\mu$, preferably a thickness of about 20$\mu \pm 10\%$.

11. The method defined in claim 1 further comprising the steps of detecting current between the metal rod and the other capacitor surface and terminating further movement of the rod in response to the detected current before the step of passing a deforming electric current between the capacitor plates.

12. The method defined in claim 1 further comprising the step of forming one capacitor surface of a thickness substantially less than the thickness of the other capacitor surface.

13. The method defined in claim 12 further comprising the step of producing a ratio of capacitor surface thicknesses between 1:3 and 1:7.

* * * * *